United States Patent [19]

Marsh, Jr. et al.

[11] 4,190,994

[45] Mar. 4, 1980

[54] FILLER PANEL CLIP FOR PRESTRESSED CONCRETE DOUBLE-TEE ROOF OR FLOOR CONSTRUCTION

[76] Inventors: Paul A. Marsh, Jr.; Tom A. Thomas, III, both of 5500 S. High, Oklahoma City, Okla. 73129

[21] Appl. No.: 858,709

[22] Filed: Dec. 8, 1977

[51] Int. Cl.[2] ..... E04C 1/36

[52] U.S. Cl. ..... 52/262; 52/404; 52/602; 52/713

[58] Field of Search ..... 52/713, 407, 476, 262, 52/732, 241, 602, 542, 94, 404, 405, 238; 24/260 R

[56] References Cited

U.S. PATENT DOCUMENTS

| | | | |
|---|---|---|---|
| 2,123,761 | 7/1938 | Morton | 52/407 |
| 2,171,338 | 8/1939 | Henderson | 52/602 |
| 2,294,554 | 9/1942 | Henderson | 52/602 |
| 3,303,626 | 2/1967 | Brigham | 52/732 |
| 3,872,633 | 3/1975 | Altosaar | 52/732 |

*Primary Examiner*—John E. Murtagh

*Attorney, Agent, or Firm*—Dunlap, Codding & McCarthy

[57] ABSTRACT

A two-piece clip, utilized to maintain a concrete filler panel positioned in a cavity formed between a double-tee roof or floor member and a wall partition over which the double-tee member extends, comprises a female portion fastened to the undersurface of the double-tee within the cavity and above the wall partition, and a male portion which is lockingly engaged to the female portion after positioning the filler panel in the cavity. The clip is movable in relation to the filler panel during normal flexing of the double-tee member relative to the partition wall.

7 Claims, 4 Drawing Figures

FILLER PANEL CLIP FOR PRESTRESSED CONCRETE DOUBLE-TEE ROOF OR FLOOR CONSTRUCTION

BACKGROUND OF THE INVENTION

1. Field of the Invention

The present invention relates generally to the field of construction and, more particularly but without limitation, to the use of pre-stressed concrete members commonly referred to as double-tees.

2. Prior Art

Double-tee structural members are quite often used to form a deck such as, for example, a roof for a building structure. A double-tee generally comprises a planar deck portion, with two legs, or tee portions, extending generally perpendicularly therefrom. Thus, an open space, or cavity, is formed between the legs and a medial portion of the deck, with the deck substantially overhanging the legs. When a plurality of double-tees are positioned side by side and supported on the bearing walls of a building structure, a plurality of such open spaces are formed, as each of the open spaces forms a cavity between one or more of the double-tee members and the wall.

In addition to the bearing walls which support the end portions of the double-tee members, it is frequently the practice to construct walls positioned beneath a deck constructed of double-tees between the ends of the double-tees. Such intermediate walls may be loadbearing or non-loadbearing. In order to isolate or separate a room formed via such a wall, concrete filler panels are supported on top of the walls and positioned to fill the cavities formed via the double-tee members and the walls. These filler panels, constructed to fit snugly within the cavities, are generally rectangularly shaped and normally weigh in excess of one hundred pounds each. Of course, the filler panels can also be utilized in conjunction with the loadbearing walls supporting the end portions of the double-tee members.

Generally, upon initial installation of a typical filler panel, a bead of mortar or caulking compound is run around the joint formed between the filler panel and a respective double-tee member. Thus, by way of a sealed joint, in cooperation with the relatively heavy weight of the filler panel bearing on the wall, it would seem that the filler panel would remain in the desired position. However, due to the well known nature of concrete and steel (the concrete utilized in forming a double-tee member being reinforced with steel), the double-tee member will normally tend to flex upwardly from time to time in relation to the wall. As a result, this flexing may cause the sealed joints to separate. Because of this condition, it is possible for the filler panels to actually fall out of the cavity and off the wall. Clearly, this would present a danger to any person occupying a position near the wall.

In order to alleviate this problem, the manufacturer places steel plates or connecting brackets into the filler panels to be connected to mating steel plates or connecting brackets molded into the double-tee members, so that such connecting brackets can be bolted or welded together when the filler panels are in position. However, this requires the use of more expensive forming methods for molding the double-tee members and filler panels, for each building structure. Clearly, the initial cost of such a solution is more costly; the existing standards to which the double-tee members are constructed have to be changed, resulting in complicating the design of the double-tee members, a change that the huge double-tee construction industry does not like because of the cost alone. Additionally, the cost of assembling each filler panel into place and bolting or welding the connecting brackets is not economical when compared to the present cost of merely sealing the joints with mortar or the like.

SUMMARY OF THE INVENTION

The present invention provides a clip assembly for maintaining a filler panel in position within a cavity formed between a double-tee member and a wall partition while permitting the upward flexing of the double-tee member. The clip assembly is in the form of a two piece assembly including a female portion and a male portion which is lockingly engagable with the female portion. In practice, the female portion is fastened to the under surface of a selected double-tee above a wall positioned thereunder, prior to positioning a filler panel within the respective cavity. After the filler panel is in position, the male portion is inserted into the female portion such that the clip assembly substantially grips the filler panel. Thus, if the double-tee member should flex, the clip assembly will move therewith while grippingly engaging the filler panel. As required, one or more of the clip assemblies can be utilized with each filler panel, and the clip assemblies can be positioned to grip the top portion and/or the side portions of the filler panel, as desired.

It is therefore an object of the present invention to provide an apparatus for retaining a filler panel positioned within a cavity formed between a wall and a double-tee member extending over the wall.

Another object of the present invention is to provide an apparatus for retaining a double-tee filler panel in accordance with the above stated object that permits the flexing of the double-tee member while maintaining the position of the filler panel.

One other object of the present invention is to provide a clip assembly which can easily and economically be manufactured and installed, and is superior to filler panel retention methods used in the past.

Other objects, advantages, and features of the present invention will be evident from the following specification when read in conjunction with the drawings and appended claims.

DESCRIPTION OF THE PREFERRED EMBODIMENT

Figure 1:
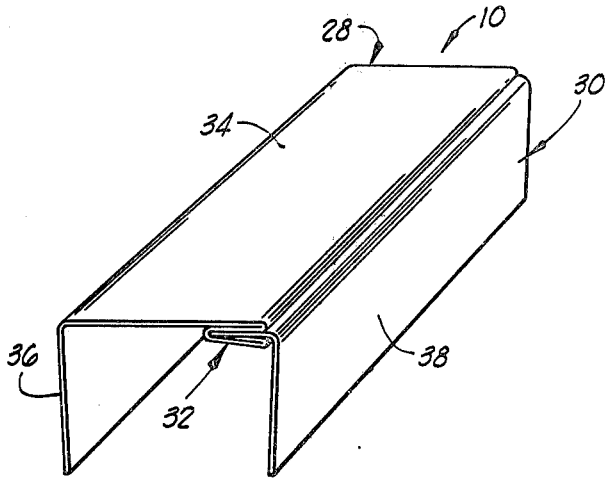
FIG. 1 is an isometric view of a clip assembly constructed in accordance with the present invention.
Figure 2:
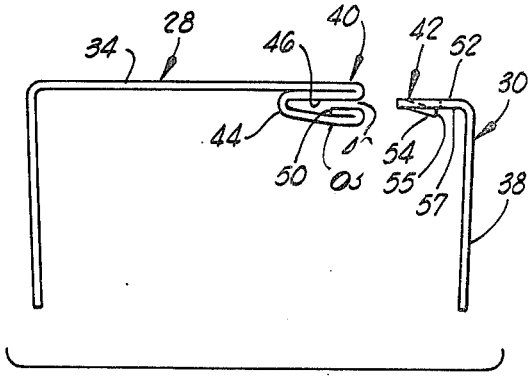
FIG. 2 is an end elevational view of the male and female portions of the clip assembly shown in FIG. 1, in a disassembled position thereof.
Figure 3:
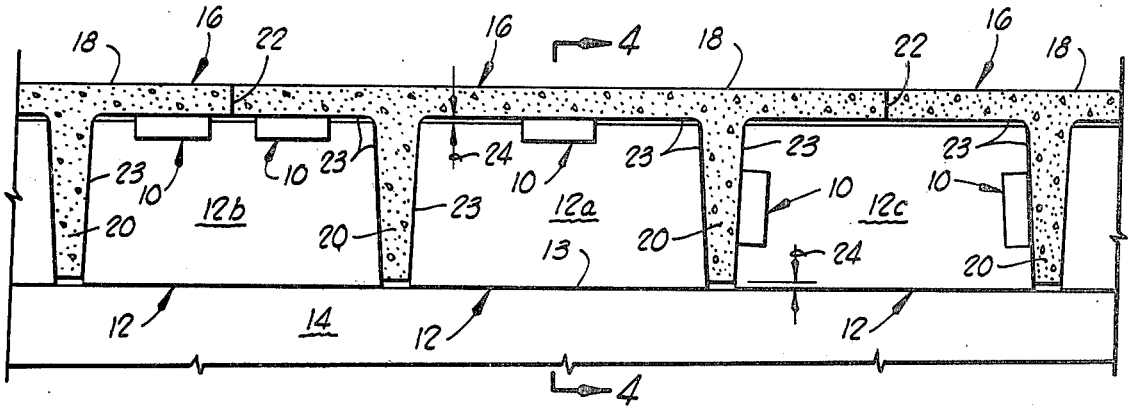
FIG. 3 is a partial sectional view of a roof deck constructed of double-tee structural members extending over a wall with a plurality of filler panels resting on the wall and positioned within cavities formed between the double-tee structural members and the wall. A plurality of the clip assemblies shown in FIG. 1 are shown in a variety of contemplated positions for retaining the filler panels within the cavities.
Figure 4:
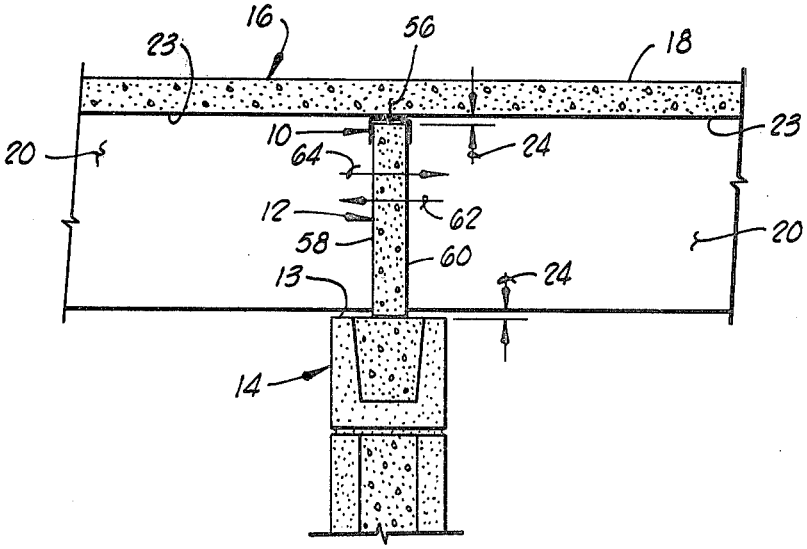
FIG. 4 is a partial cross-sectional view taken along the line 4—4 of FIG. 3.

Referring to the figures in general and to FIGS. 1 and 2 in particular, shown therein is a clip apparatus 10 constructed in accordance with the present invention. Referring also to FIGS. 3 and 4, the clip apparatus 10 is generally utilized to retain a filler panel 12 positioned within a cavity formed between a top surface 13 of a wall 14 and a double-tee 16 extending over the wall 14.

As shown in the drawings, the wall 14 is of conventional block and mortar construction, or the like, such as is commonly found in building structures. A typical double-tee member 16 generally has a deck portion 18 which is integrally formed with a pair of legs, or tee portions, 20 that extend generally the length of the deck portion 18. The double-tee member 16 is formed of a high strength concrete mixture and is reinforced with pre-stressed steel strands (not shown) running the length of the tee leg 20.

A plurality of the double-tees 16 are commonly utilized to form a deck or the like, such as a roof for example, on a building structure. More particularly, each double-tee 16 is supported near each end thereof via a load bearing wall (not shown) over which the respective double-tee 16 extends. In a situation where the double-tee members 16 span a relatively long distance, one or more bearing walls may be positioned intermediate the ends of the double-tees 16 if necessary. In addition, one or more non-bearing walls may also be positioned intermediate the bearing walls to form rooms within the building structure. For purposes of this disclosure, the wall 14 can represent either a bearing or non-bearing wall positioned intermediate the ends of the double-tees 16.

After the double-tees 16 have been positioned over the walls of the building structure, a cavity or opening is inherently formed between each pair of legs 20 and the adjacent top surface 13 of the wall 14. In other words, such a cavity is formed between the related legs 20 of each double-tee 16, as well as between the legs 20 disposed on either side of a joint 22 formed between adjacent double-tees 16. Thus, in order to effectively extend the wall 14 to the ceiling formed via the undersurface 23 of the double-tees 16, one of the filler panels 12 is positioned within each cavity.

A typical filler panel 12 is formed of a concrete mix, is generally rectangular in shape as can be seen in FIG. 3, and generally has a thickness of approximately 2 to 3 inches. Furthermore, since the legs 20 of a typical double-tee 16 are conventionally spaced about four feet apart, on center, a typical filler panel 12 can easily weigh over one hundred pounds. It should also be noted that the filler panels 12 are constructed to generally conform to the shape and size of the cavities when the double-tee members 16 are resting upon the top surface 13 of the wall 14.

In an actual working situation, the double-tee members 16 sometimes tend to flex upwardly at the medial portions thereof, due to the response of the cement and steel to the changes in the ambient conditions of their environment. Thus, as can be seen in FIGS. 3 and 4, the double-tees 16 may be displaced a distance 24 above the wall 14. In the past, the filler panels 12 were maintained in position within a respective cavity by placing a bead of mortar or caulking compound around each filler panel 12 when positioned within the cavity. However, repeated flexing of the double-tees 16 can eventually loosen the sealed joints. It is therefore possible that a filler panel 12 can, after becoming disjoined from the undersurface 23 of the double-tees 16, actually be dislodged from its normally static position and tip over or fall from the top surface 13 and into a room partitioned via the wall 14, due to normal shifting and vibrations inherent to the building structure. Clearly, a falling object having the mass of one of the filler panels 12 would present a highly dangerous and possibly lethal condition. In addition, notwithstanding personal injury, damage would be likely to occur to any objects positioned below a falling filler panel 12, as well as damages to, or destruction of, the filler panel 12 upon colliding with a ground surface. Thus it becomes desirable if not mandatory, to provide means for retaining the filler panels 12 continuously positioned upon the wall 14.

The clip apparatus 10 of the present invention does indeed provide a panel retaining means for retaining a filler panel 12 within a cavity occupied thereby. More particularly, the clip apparatus 10 is connected, or anchored, to a double-tee 16 and is engaged with an associated filler panel 12 such that the clip apparatus 10 moves with the double-tee 16 in relation to the filler panel 12 in response to a flexing of the double-tee 16.

The clip apparatus 10 generally comprises a first retaining portion 28 and a second retaining portion 30 which are lockingly engageable via a locking connector 32. More particularly, the first retaining portion 28 includes an anchoring flange 34 and a first backup plate 36 extending generally perpendicularly therefrom. A portion of the locking connector 32 is connected to the anchoring flange 34 opposite the first backup plate 36, as can be seen more clearly in FIG. 2. The second retaining portion 30 includes a second backup plate 38 with another portion of the locking connector 32 being connected to the second backup plate 38.

The locking connector 32 includes a female connector portion 40 and a male connector portion 42 which is generally insertable into and engageable with the female portion 40. As shown in FIG. 2, the female connector portion 40 is connected generally to the first retaining portion 28 and specifically to the anchoring flange 34, while the male connector portion 42 is connected to the second backup plate 38, or second retaining portion 30.

More particularly, the female connector portion 40 comprises a bifurcated clip 44 which is connected to the anchoring flange 34 opposite the first backup plate 36. One of the furcations of the clip 44 defines a base 46 with the other of the furcations defining a cover 48 extending generally from the base 46 in a substantially parallel relationship therewith, such that a receiving slot 49 is formed therebetween. A locking element 50 is formed on the cover 48 within the receiving slot adjacent a slot opening, for purposes to be made apparent below.

The male portion 42 of the locking connector 34 includes a tab 52 which is connected to the second backup plate 38 and extends generally perpendicularly therefrom. At least one wedge element 54 is formed on the tab 52, the wedge element 54 tapering in a direction away from the second backup plate 38, as can be seen in FIG. 2. The male portion 42 is engageable with the female portion 40 via inserting the tab 52 into the tab receiving slot 49 of the clip 44.

In the preferred embodiment, the first retaining portion 28 is constructed from a single piece of sheet material, such as galvanized iron sheet metal for example, with the female connector portion 40 formed into the shape of the clip 44 by bending and crimping along the edge portion of the anchoring flange 34 as shown in FIG. 2. The second retaining portion 30 is also preferably formed from a single piece of sheet material with the wedge 54 being embossed via stamping and lifting a portion of the tab 52 so that a locking edge 55 is exposed a predetermined distance from the surface 57 of the tab 52.

In order to utilize the clip apparatus 10, the first retaining portion 28 is connected, or anchored, to a double-tee 16 within an adjacent cavity above and in longitudinal alignment with the wall 14. This is most effectively done by driving a nail 56 or the like through the anchoring flange 34 and into the double-tee 16, as shown in FIG. 4. A filler panel 12 can then be positioned within the cavity upon the upper surface 13 of the wall 14, with a first surface 58 of the filler panel 12 resting against the first backup plate 36 of the clip apparatus 10. Then, the tab 52 of the second retaining portion 30 is seated in the clip 44 in alignment with the receiving slot 49 formed therein and driven into the slot 49 such that the second backup plate 38 substantially rests against a second surface 60 on the opposite side of the filler panel 12.

As the tab 52 is driven into the receiving slot 49, the wedge 54 tends to spread the cover 48 away from the base 46 as the wedge 54 slides over the locking element 50 (the base 46 bearing against the double-tee 16 and, thus, being substantially immovable). When the tab 52 is fully inserted between the base 46 and the cover 48, the wedge 54 clears the locking element 50 whereby the tab 52 is substantially gripped via the base 46 and the clamp 48, due to the resilient nature of the sheet material, with the locking element 50 acting as a stop means against the locking edge 55 and providing a resistance to movement of the tab 52 away from the clip 44.

It should be noted that the first and second retaining portions 28 and 30 are constructed such that, in an assembled position thereof, the distance between the first and second backup plates 36 and 38 adjacent the anchoring flange 34 is approximately equal to the thickness of the filler panel 12. In addition, the first and second retaining portions 28 and 30 are also formed such that the distance between the first and second backup plates 36 and 38 away from the anchoring flange 34 is somewhat less than the thickness of the filler panel 12. Thus, in addition to merely retaining the filler panel 12, the clip apparatus 10 will tend to grip the filler panel 12 such that no slack is present therebetween.

It should be clear from the above that in a retaining position of the clip apparatus 10, the first retaining portion 28, or the first backup plate 36, provides a resistance to movement of the filler panel 12 in a first direction 62 relative to the double-tee 16, while the second retaining portion 30, or the second backup plate 38, provides a resistance to movement of the filler panel 12 in a second direction 64 opposite the first direction 62. Furthermore, the wedge 54 and the locking element 50 cooperate to maintain the tab 52 engaged with the clip 44 in response to any tendency of the filler panel 12 to move in the second direction 64.

In a working environment, as shown more clearly in FIG. 3, it is contemplated within the scope of the present invention that one or more of the clip apparatus 10 may be selectively positioned in relation to a respective filler panel 12 to carry out the stated objects and intent of the present invention. For example, referring to the filler panel designated **12*a* in FIG. 3, the clip apparatus 10 is shown connected to the deck portion 18 of an adjacent double-tee 16 midway between the related legs 20 and above the filler panel 12*a*. Of course, if the use of more than one of the clip apparatus 10 is deemed necessary, a plurality thereof may be utilized, such as is shown utilized with the filler panel designated 12*b*. This may be desirable when a filler panel 12 is positioned within a cavity formed between adjacent double-tees 16. Another filler panel designated 12*c* is shown retained between adjacent double-tees 16 via two of the clip apparatus 10 which have been anchored to respective legs 20 of the double-tees 16. Of course, any number of the clip apparatus 10 as described above may be utilized as is required by a particular situation. Also, it will be noted that the filler panel 12 may be sealed, if desired, by placing a caulking bead or the like thereabout in the manner that is presently practiced without interfering with the operation of the retaining clip apparatus 10**.

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the following claims.

What is claimed is:

1. In a structure having a double-tee construction member extending over a wall forming a cavity therebetween and a filler panel resting on the wall and positioned within the cavity, the improvement comprising:

clip means connectable to the double-tee within the cavity for retaining the filler panel within the cavity so that the filler panel is retained in the cavity when the double-tee exerts flexing movement relative to the wall, the clip means comprising:

a first retaining portion supportable on the underside of the double-tee;

a second retaining portion; and locking connector means for connecting the first retaining portion and the second retaining portion in locking engagement so that the first retaining portion provides backup to one side of the filler panel and the second retaining portion provides a backup to the opposite side of the filler panel, the locking connector comprising:

a female connector portion connected to the first retaining portion, the female connector portion comprising a bifurcated clip, a first furcation thereof being connected to the first retaining portion, and the second furcation being connected to and generally parallel with the first furcation with a tab receiving slot being formed between the furcations;

a male connector portion connected to the second retaining portion, the male connector portion being lockingly engagable with the female connector portion, the male connector having a tab connected to the second retaining portion, the tab being insertable into the tab receiving slot; and tab retaining means for maintaining the tab positioned within the tab receiving slot.

2. The apparatus of claim 1 wherein the tab retaining means is characterized as comprising:

clip spreading means for spreading the furcations apart when the tab is inserted therebetween whereby the furcations tend to grip the tab; and stop means for maintaining the tab positioned in the receiving slot to resist the removal of the tab from the receiving slot.

3. The apparatus of claim 2 wherein the spreading means is characterized as comprising:

a wedge connected to the tab; and wherein the stop means is characterized as comprising:

a locking element connected to the bifurcated clip, the wedge sliding over the locking element and tending to expand the bifurcated clip when the tab is inserted into the tab receiving slot, and the locking element resisting a tendency of the tab to slip out of the tab receiving slot in response to the movement of the filler panel.

4. A filler panel retaining clip apparatus for use with a double-tee construction member extending over a wall and forming a cavity therebetween, and a filler panel positioned to rest on the wall within the cavity, the clip apparatus comprising:

a first retaining portion characterized as comprising:

a first backup plate;

an anchoring flange connected to one end of the first backup plate and extending generally perpendicularly therefrom, the anchoring flange attachable to the double-tee member; and a bifurcated clip connected to the anchoring flange, a first furcation thereof attached to the anchoring flange, a second furcation integrally formed with the first furcation and forming with said first furcation a tab receiving slot; and a second portion characterized as comprising:

a second backup plate; and a tab connected to and extending generally perpendicularly from one end of the first backup plate, the tab being lockingly insertable in the tab receiving slot formed by the furcations of the bifurcated clip whereby the first and second backup plates are positioned in a spaced apart relationship so that the first backup plate is positionable to one side of the filler panel and the second backup plate is positioned on the opposite side of the filler panel.

5. The apparatus of claim 4 wherein the tab is defined as comprising:

at least one wedge formed thereon; and wherein the bifurcated clip is defined further as comprising:

a locking element formed thereon between the furcations in the tab receiving slot, the wedge engaging and sliding over the locking element when the tab is inserted between the furcations, with the wedge clearing the locking element whereby the locking element maintains the tab positioned between the furcations in response to movement of the second backup plate away from the first backup plate.

6. The clip apparatus of claim 5 wherein the first retaining portion is characterized as comprising:

a single piece of sheet material forming the anchoring flange, the first backup plate, the bifurcated clip and the locking element; and wherein the second retaining portion is characterized as comprising:

a single piece of sheet material forming the second backup plate, the tab and the wedge.

7. The clip apparatus of claim 6 wherein the distance between the first backup plate and the second backup plate adjacent the anchoring flange in the assembled position of the clip apparatus is approximately equal to the thickness of the filler panel, and wherein said distance is somewhat greater than the distance between the first and second backup plates at the ends thereof opposite the anchoring flange so that the assembled clip apparatus grips the filler panel on opposite sides thereof.

* * * * *